US006789697B2

(12) United States Patent
Neess

(10) Patent No.: US 6,789,697 B2
(45) Date of Patent: Sep. 14, 2004

(54) ADJUSTABLE CUP DISPENSER

(75) Inventor: Carl R. Neess, Pardeeville, WI (US)

(73) Assignee: Traex Company, Toledo, OH (US)

( * ) Notice: Subject to any disclaimer, the term of this patent is extended or adjusted under 35 U.S.C. 154(b) by 106 days.

(21) Appl. No.: 10/219,221

(22) Filed: Aug. 14, 2002

(65) Prior Publication Data

US 2004/0031811 A1 Feb. 19, 2004

(51) Int. Cl.[7] ..... A47F 1/04
(52) U.S. Cl. ..... 221/305; 229/122.1
(58) Field of Search ..... 221/53, 45, 63, 221/64, 65, 221, 226, 44, 303, 304, 305, 810; 206/515; 229/122.2, 126

(56) References Cited

U.S. PATENT DOCUMENTS

| | | | | | |
|---|---|---|---|---|---|
| 1,565,306 | A | | 12/1925 | Bergman et al. | |
| 3,069,048 | A | | 12/1962 | Easton et al. | 221/45 |
| 3,232,480 | A | * | 2/1966 | Stanley | 221/305 |
| 3,392,878 | A | | 7/1968 | Jackson | 221/65 |
| 3,490,646 | A | | 1/1970 | Pritchard | 221/310 |
| 3,581,934 | A | | 6/1971 | Sciasca | 221/304 |
| 3,623,636 | A | | 11/1971 | D'Ercoli et al. | 221/64 |
| 3,790,023 | A | | 2/1974 | Filipowicz | 221/304 |
| 3,820,686 | A | * | 6/1974 | Tyvseck | 221/305 |
| 3,899,118 | A | * | 8/1975 | Hollinger | 221/199 |
| 3,938,703 | A | | 2/1976 | Roccaforte | 221/305 |
| 4,899,929 | A | * | 2/1990 | Grollman | 229/122.1 |
| 5,014,878 | A | | 5/1991 | Janz | 221/279 |
| 5,076,465 | A | * | 12/1991 | Lawson | 221/47 |
| 5,884,803 | A | | 3/1999 | Vine | 221/44 |

* cited by examiner

*Primary Examiner*—Kenneth Noland
(74) *Attorney, Agent, or Firm*—Emch, Schaffer, Schaub & Porcello Co., L.P.A.

(57) ABSTRACT

An adjustable cup dispenser includes a tubular body having overlapping portions extending between a discharge opening at one end and an opposing end. A fastening mechanism selectively fixes the overlapping portions relative to each other to define a desired tubular body diameter. A plurality of radially inwardly extending dual-length fingers extend from the discharge opening for engaging a cup disposed in the tubular body. The dispenser body and fingers can be formed from a single sheet of flexible material, and then folded and rolled into the shape of the cup dispenser. The overlapping sides can be repositioned to define a different tubular body diameter.

16 Claims, 5 Drawing Sheets

ADJUSTABLE CUP DISPENSER

CROSS REFERENCES TO RELATED APPLICATIONS

Not Applicable.

STATEMENT REGARDING FEDERALLY SPONSORED RESEARCH

Not Applicable.

FIELD OF THE INVENTION

The present invention relates to a dispenser for cups, and more particularly to an adjustable cup dispenser which can be formed from a blank cut from a sheet of material.

BACKGROUND OF THE INVENTION

Disposable cups are typically provided by an elongated dispenser having a body and a discharge opening through which individual cups are dispensed. The stack of substantially identical nested cups are stored in the body, and the bottom cups protrude through the discharge opening. A user grasps the bottom cup which separates from the stack, and pulls the cup out of the discharge opening.

The dispenser is typically designed for a cup having a specific maximum diameter, and cannot be used or reused for a stack of cups having a larger or smaller diameter. Dispensers have been developed that can accommodate a range of cup diameters, but these dispensers are complicated and expensive. For example, U.S. Pat. No. 3,581,934 discloses a molded cylindrical housing having a cylindrical control sleeve. The control sleeve includes a multifaceted cam ring having a plurality of differing radius cam faces which must be adjusted for each different sized cup. Another adjustable cup dispenser disclosed in U.S. Pat. No. 3,790,023 includes radially adjustable cup supporting tabs which engage cams that must be adjusted for each different sized cup.

The tubular body of the above disclosed cup dispensers is not adjustable to accommodate different sized cups. As a result, smaller cups can be skewed in the body before reaching the discharge opening. Another problem with adjustable cup dispensers is the release of multiple cups when a user desires only a single cup. Moreover, the mechanisms required to accommodate different sized cups are formed from multiple pieces and are expensive to manufacture and assemble.

Inexpensive and simple cup dispensers can be formed by cutting blanks from a sheet material, and then folding the blanks to form the cup dispenser. Typical cup dispensers formed from a blank are disclosed in U.S. Pat. Nos. 3,490,646 and 3,820,686. Unfortunately, these dispensers are designed for a single cup size, and are typically discarded after a single use.

SUMMARY OF THE INVENTION

The present invention provides an adjustable cup dispenser and method of making the cup dispenser. The cup dispenser includes a tubular body having overlapping portions extending between a discharge opening at one end and an opposing end. A fastening mechanism selectively fixes the overlapping portions relative to each other to define a desired tubular body diameter. A plurality of radially inwardly extending fingers extend from the discharge opening for engaging a cup disposed in the tubular body. The dispenser body and fingers can be formed from a single sheet of flexible material, and then folded and rolled into the shape of the cup dispenser.

A general objective of the present invention is to provide an adjustable cup dispenser. This objective is accomplished by providing a cup dispenser having a body including overlapping portions which can be selectively fixed relative to each other to accommodate different sized cup stacks.

Another objective of the present invention is to provide a simple and inexpensive cup dispenser and method of making it. This objective is accomplished by providing a cup dispenser formed from a blank cut from a flexible sheet of material.

Another objective of the present invention is to provide a cup dispenser which consistently dispenses individual cups. This objective is accomplished by providing a cup dispenser with fingers extending from the cup dispenser discharge opening, wherein the fingers have at least two different lengths for engaging the cups.

This and other objectives and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
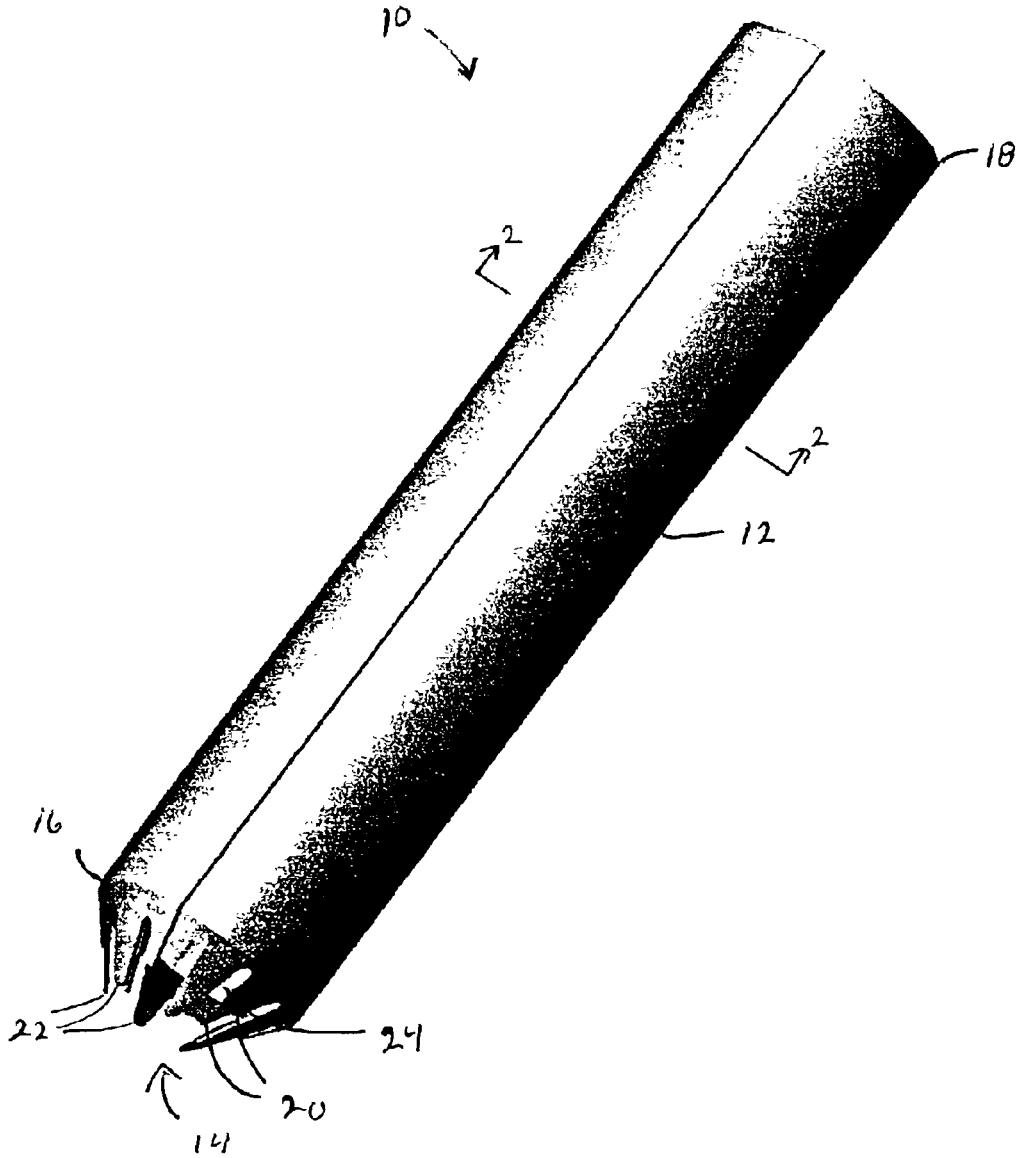
FIG. 1 is a perspective view of a cup dispenser incorporating the present invention.
Figure 2:
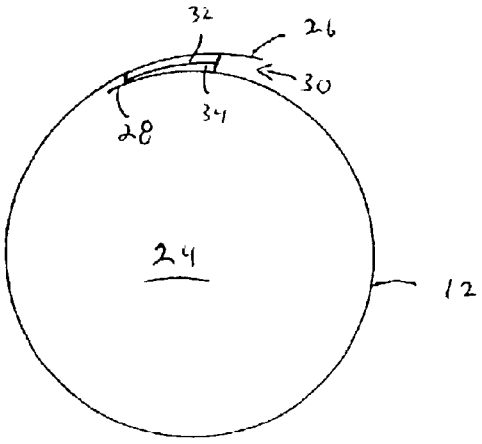
FIG. 2 is a cross sectional view along line 2—2 of FIG. 1.
Figure 3:
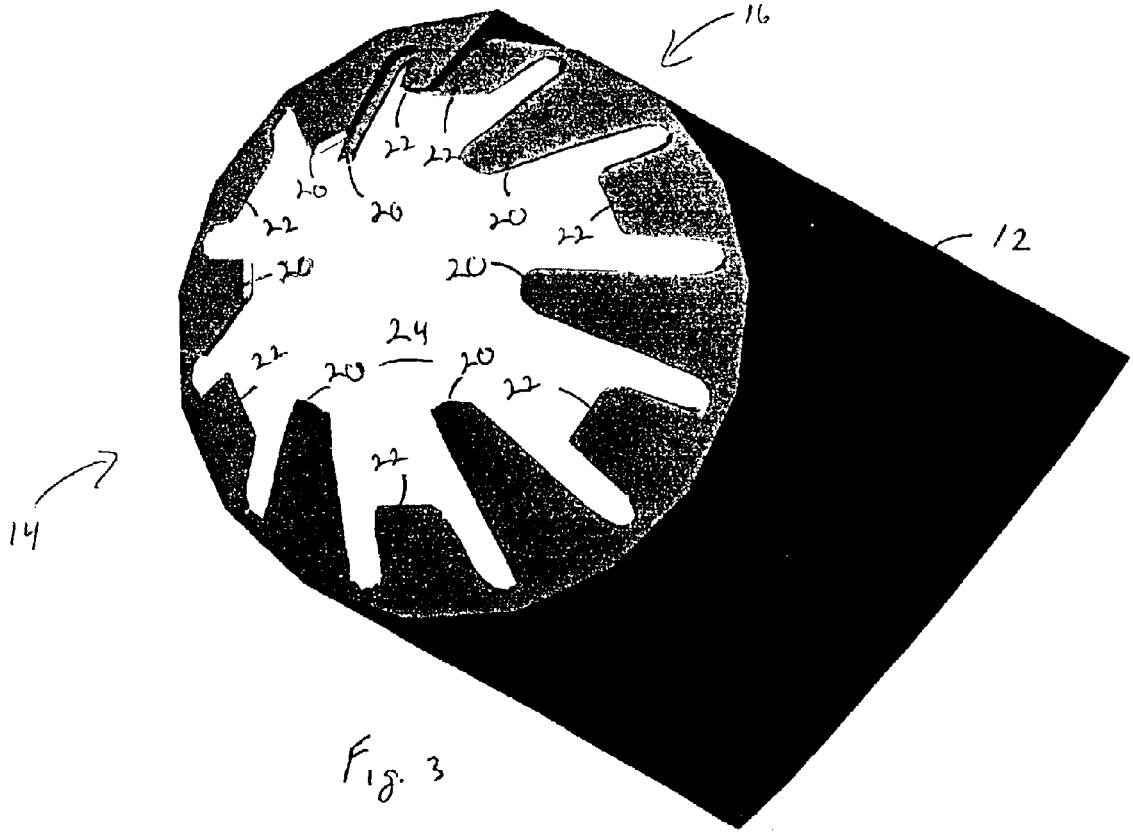
FIG. 3 is a bottom perspective view of the cup dispenser of FIG. 1.

A cup dispenser 10 incorporating the present invention shown in FIGS. 1–3 includes a tubular body 12 having a discharge opening 14 at one end 16 and an opposed end 18. Cups (not shown) having substantially the same maximum diameter are stored in the tubular body 12 and dispensed through the discharge opening 14. Fingers 20, 22 extending radially inwardly from the discharge opening 14 engage each cup as it is dispensed from the body 12 through the discharge opening 14 to separate and guide the cup being dispensed from the remaining cups in the body 12. Advantageously, the dispenser 10 is adjustable for use with a range of maximum cup diameters.

The body 12 defines an internal space 24 having a tubular body diameter for storing a plurality of nested cups, and includes overlapping portions 26, 28 fixed relative to each other. Preferably, the tubular body diameter is substantially constant or slightly tapering along the entire length of the body 12. The overlapping portions 26, 28 extend axially between the body ends 16, 18, and are positionable relative to each other between the body ends 16, 18. Advantageously, relative movement of body overlapping portions 26, 28 changes the tubular body diameter of the body space 24 as required for the cups stored therein.

The overlapping portions 26, 28 are fixed relative to each other by a fastening mechanism 30 which selectively fixes the overlapping portions 26, 28 relative to each other to define a desired tubular body diameter. Preferably, the fastening mechanism 30 is formed from hook and loop material 32, 34, such as Velcro®, wherein the hook material 32 is fixed to one of the overlapping portions 26, 28 and the loop material 34 is fixed to the other overlapping portion 26, 28, such that the hook and loop materials 32, 34 are engageable with each other to selectively fix the overlapping portions 26, 28 relative to each other. The hook and loop materials 32, 34 are fixed to the respective overlapping portions 26, 28 using methods known in the art, such as by an adhesive, and the like.

Of course, other fastening mechanisms known in the art can be used to selectively fix the overlapping portions 26, 28 relative to each other to define a desired tubular body diameter. For example, an adhesive, preferably, a releasable adhesive can be used. One or more hose clamps surrounding the body 12 can be used to fix the overlapping portions 26, 28 relative to each other. Other methods which fix the overlapping portions 26, 28 at discrete positions can also be used without departing from the scope of the invention. For example holes formed in one overlapping portion 26, 28 can receive a pin fixed to the other overlapping portion 26, 28 can be used, or tabs can be received in slots corresponding to different diameters.

The fingers 20, 22 extending radially inwardly from the discharge opening 14 of the body 12 engage the cups to separate the cup being discharged from the cups stored in the body space 24. Preferably, fingers 20 having a first length alternate with fingers 22 having a second length. The first length is greater than the second length to guide the cup being dispensed from the remaining cups in the body space 24 and the shorter fingers 22 help separate the bottom cup from the stack of cups. Although fingers having two different lengths are disclosed and preferred, the fingers can be provided with more or less than two different lengths without departing from the scope of the invention.

The different length fingers 20, 22 guide and separate the cup being dispensed from the remaining cups. The shorter fingers 22 retain the stack of cups in the body 12, while the longer fingers 20 guide the cups out of the body 12, as well as, keep the orientation of the next cup to be dispensed in a straight line with the stack of remaining cups. In addition, friction acting on the cup being dispensed is reduced once the shorter fingers 22 disengage from the cup being dispensed to promote separation of the cup being dispensed from the cups remaining in the stack of cups disposed in the body 12.

As is known in the art, a cap (not shown) can be provided which covers the opposing end 18 of the tubular body. The cap can be formed as a separate piece, or a folded over portion of the body 12. Although a cap is disclosed, the invention can be practiced without the cap.

Referring to FIGS. 1–4, the cup dispenser 10 is formed by cutting a cup dispenser blank 40 from a sheet of flexible material. Preferably, the flexible material is a flat sheet of plastic. Although a sheet of plastic material is preferred, other materials known in the art can be used, such as metal, paper, and the like, without departing from the scope of the invention.

Figure 4:
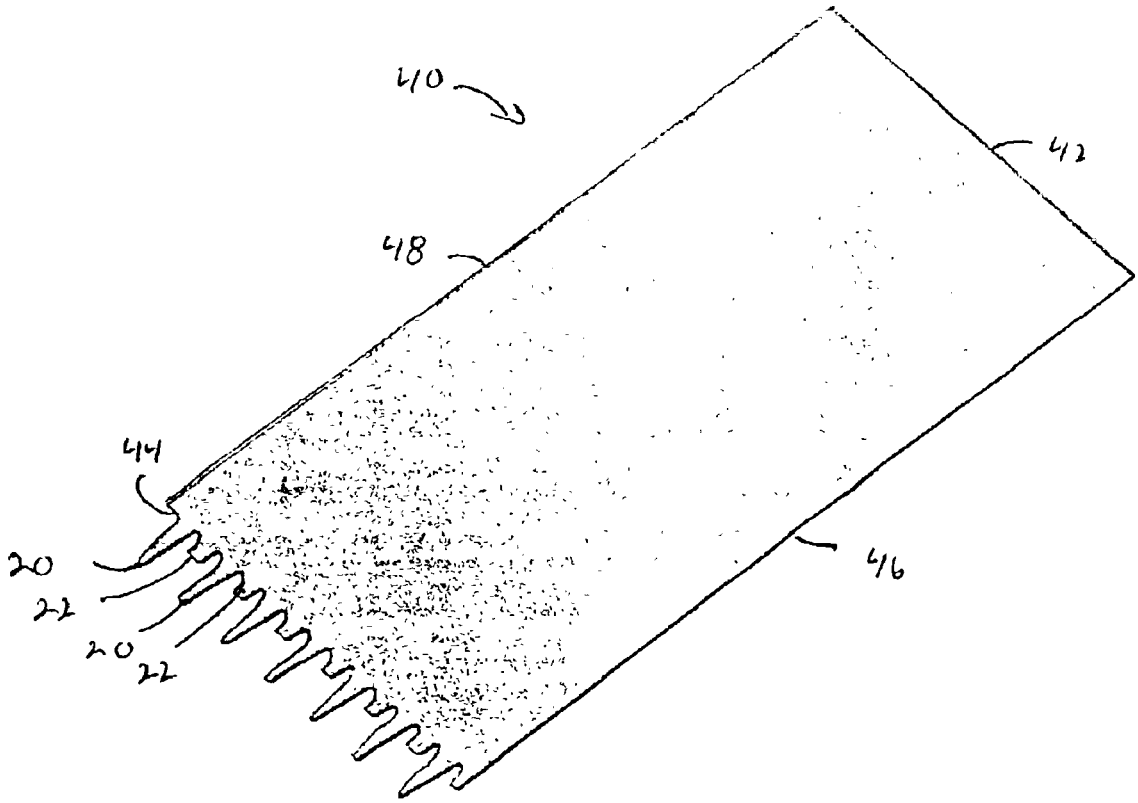
FIG. 4 is a cup dispenser blank which can be used to form the cup dispenser of FIG. 1.

As shown in FIG. 4, the cup dispenser blank 40 is substantially rectangular having a top edge 42 and bottom edge 44 joined by side edges 46, 48. Preferably, the fingers 20, 22 are formed as an integral part of the bottom edge 44. However, the fingers 20, 22 can be formed separately and attached to the blank bottom edge 44 using methods known in the art, such as fasteners, adhesives, and the like, without departing from the scope of the invention.

Figure 5:
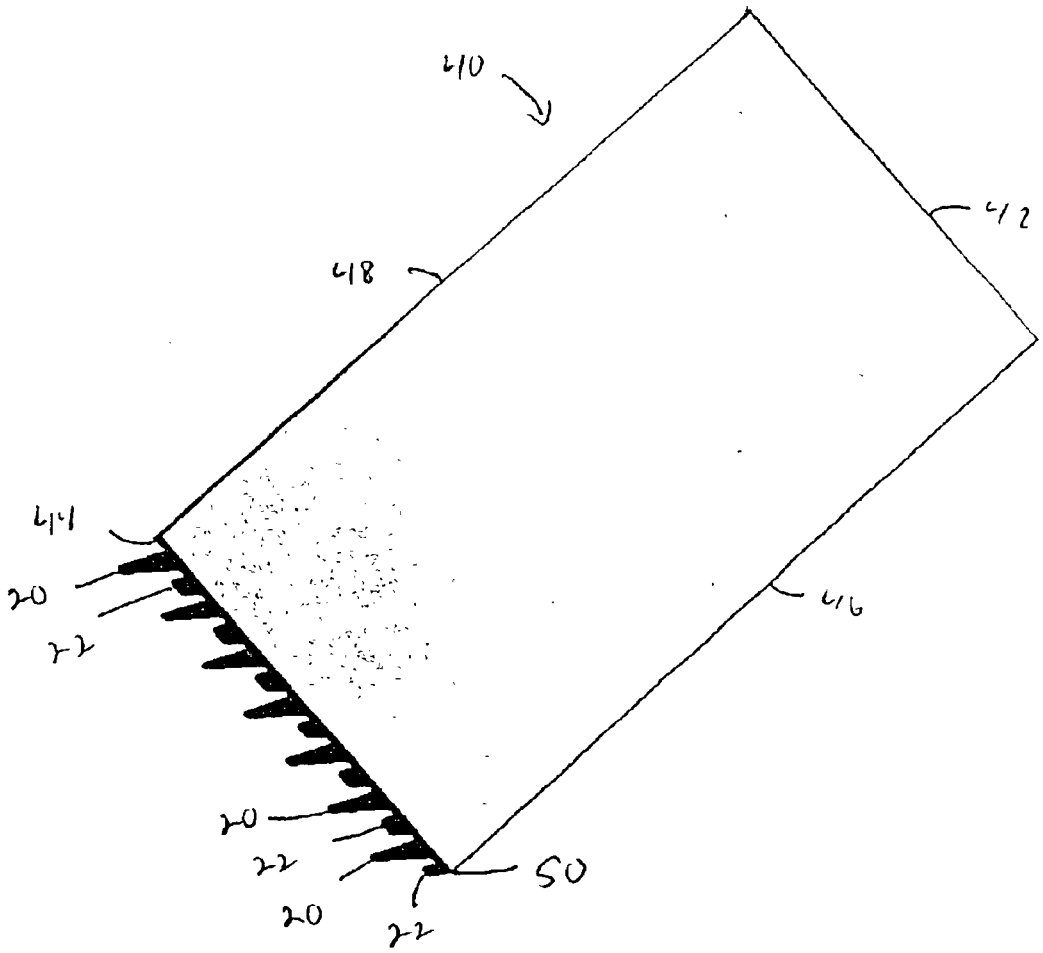
FIG. 5 is the cup dispenser blank of FIG. 4 having inwardly bent fingers.

As shown in FIG. 5, the fingers 20, 22 are then bent along a crease 50 formed proximal the bottom edge 44. If the fingers 20, 22 are formed as an integral part of a plastic cup dispensing blank, the crease 50 can be formed using methods known in the art, such as hot or cold bending, and the like. Of course, each finger 20, 22 can be individually bent without departing from the scope of the invention.

Figure 6:
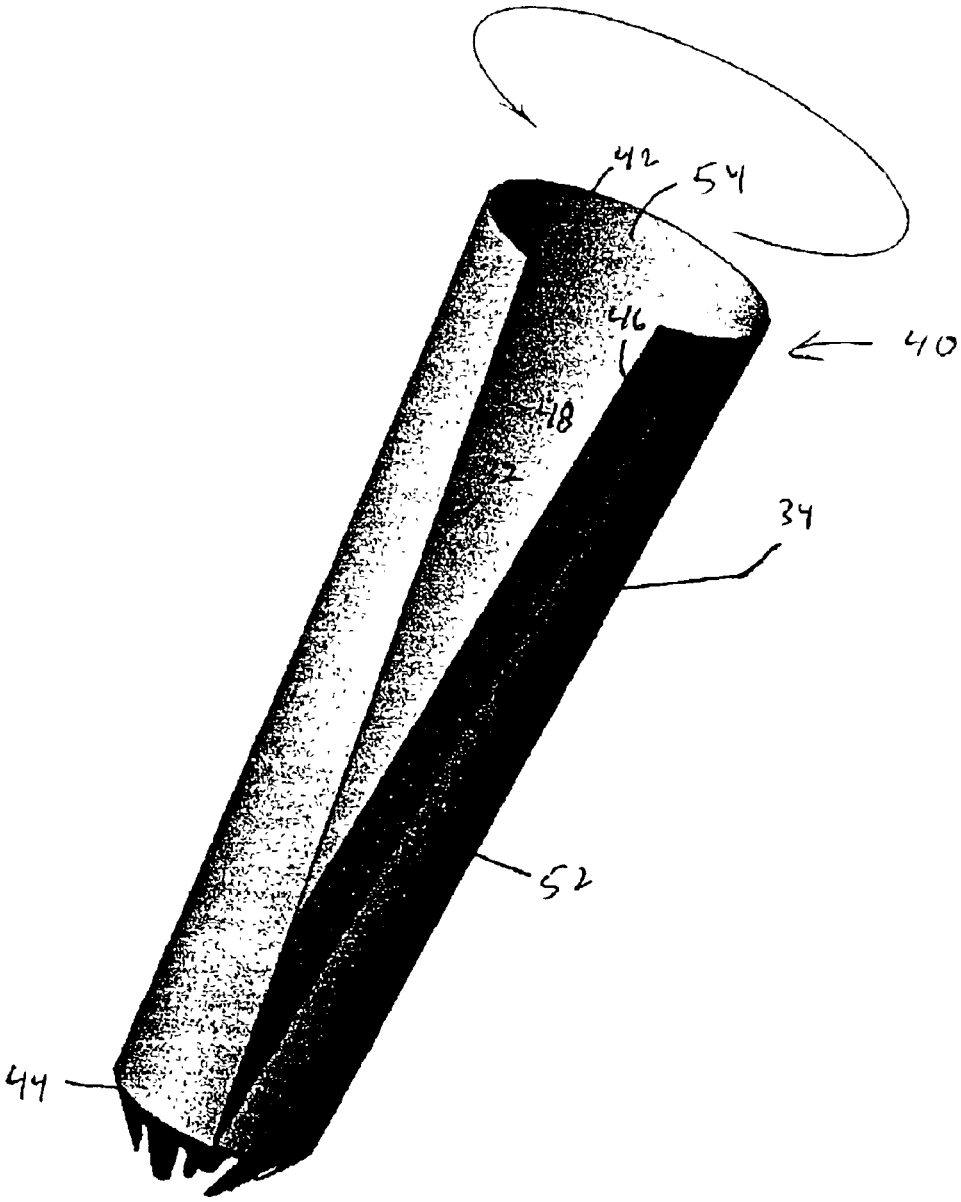
FIG. 6 is a partially rolled cup dispenser blank of FIG. 5.

Referring now to FIG. 6, preferably, the loop material 34 is adhesively fixed to one face 52 of the cup dispenser blank 40 adjacent one of the side edges 46, 38, and the hook material 32 is adhesively fixed to the opposing face 54 of the blank 40 adjacent the other side edge 46, 48. Of course, if a different fastening mechanism is used, the fastening mechanism will be assembled with the body as dictated by the requirements of the fastening mechanism and cup dispenser body.

As shown in FIG. 6, the cup dispenser blank 40 is then rolled to form the tubular body 12 having the side edges 46, 48 overlapping such that the rolled blank 40 defines the desired tubular body diameter along the entire length of the tubular body 12. Although rolling the blank 40 such that the tubular body 12 is formed having a substantially constant tubular body diameter along the entire length of the tubular body 12 is preferred, the blank 40 can be rolled to form a body having a funnel shape, or other nonconstant body diameter shape, without departing from the scope of the invention. Preferably, fingers extending from overlapped portions of the tubular body overlap fingers having the same length (best shown in FIG. 3) to avoid skewing a cup being dispensed.

Once the desired tubular body diameter is defined, the loop material 34 is urged into engagement with the hook material 32 to selectively fix the overlapping side edges 46, 48 relative to each other. Advantageously, if the assembled cup dispenser 10 is to be reused with a stack of cups requiring a different tubular body diameter, the loop material 34 can be disengaged from the hook material 32, the overlapping side edges 46, 48 can be repositioned to define the different tubular body diameter, and the loop material 34 can be urged into reengagement with the hook material 32 to selectively refix the overlapping side edges 46, 48 relative to each other.

While there has been shown and described what are at present considered the preferred embodiments of the invention, it will be obvious to those skilled in the art that various changes and modifications can be made therein without departing from the scope of the invention defined by the appended claims.

I claim:

1. An adjustable cup dispenser, comprising:

a tubular body having overlapping portions extending between a discharge opening at one end and an opposing end;

a fastening mechanism selectively fixing said overlapping portions relative to each other to define a desired tubular body diameter; and a plurality of radially inwardly extending fingers extending from said discharge opening for engaging a cup disposed in said tubular body, said plurality of fingers including a first plurality of fingers having a first length and a second plurality of fingers having a second length, wherein said first length being longer than said second length.

2. The cup dispenser of claim 1, in which said fastening mechanism includes a hook material fixed to one of said overlapping portions and a loop material fixed to another of said overlapping portions, wherein said hook material is engageable with said loop material to selectively fix said overlapping portions relative to each other.

3. The cup dispenser of claim 1, in which fingers of said first plurality of fingers alternate with fingers of said second plurality of fingers.

4. The cup dispenser of claim 1, in which said plurality of radially inward extending fingers are formed as an integral part of said tubular body.

5. The cup dispenser of claim 1, in which said opposing top is open.

6. The cup dispenser of claim 1, in which said tubular body has a substantially constant tubular body diameter between said ends.

7. A cup dispenser blank comprising:

a flexible sheet material having a top edge and bottom edge joined by side edges;

a first plurality of fingers extending from said bottom edge; and a second plurality of fingers extending from said bottom edge, said first plurality of fingers being longer than said plurality of fingers, wherein fingers of said first plurality of fingers alternate with fingers of said second plurality of fingers.

8. The cup dispenser blank of claim 7, in which said sheet material has a first face and a second face, and at least a part of a fastening mechanism is fixed to said first face adjacent one of said side edges and at least a part of said fastening mechanism is fixed to said second face adjacent the other of said side edges, wherein said fastening mechanism parts are engageable when said sheet material is rolled into a tube form.

9. The cup dispenser blank of claim 8, in which said fastening mechanism parts include hook and loop materials.

10. A method of forming a cup dispenser, said method comprising:

cutting a cup dispenser blank from a flexible sheet material, said blank having a top edge and bottom edge joined by side edges, said blank having a first plurality of fingers extending from said bottom edge having a first length and a second plurality of fingers extending from said bottom edge having a second length, said first length being longer than said second length;

rolling said blank to form a tubular body with said side edges overlapping each other, wherein said tubular body defines a desired tubular body diameter; and selectively fixing said overlapping side edges relative to each other.

11. The method of forming a cup dispenser as in claim 10, wherein said method includes folding said first and second pluralities of fingers along a crease proximal said bottom edge, and said rolling said blank includes rolling said blank such that said folded first and second pluralities fingers extend radially inwardly.

12. The method of forming a cup dispenser as in claim 10, wherein said cutting a cup dispenser blank includes forming said first and second pluralities of fingers such that fingers of said first plurality of fingers alternate with fingers of said second plurality of fingers.

13. The method of forming a cup dispenser as in claim 10, including fixing at least a part of a fastening mechanism to a first face of said sheet material adjacent one of said side edges and fixing at least a part of said fastening mechanism to a second face of said sheet material adjacent the other of said side edges, and selectively fixing said overlapping side edges includes engaging said fastening mechanism parts.

14. The method of forming a cup dispenser as in claim 10, including unfixing said overlapping side edges relative to each other, repositioning said overlapping side edges relative to each other to define a different tubular body diameter, and selectively refixing said overlapping side edges relative to each other.

15. The method of forming a cup dispenser as in claim 10, in which said cup dispenser blank is rolled to define a substantially constant tubular body diameter between said top edge and said bottom edge.

16. A method of forming a cup dispenser comprising:

cutting a cup dispenser blank from a flexible sheet material, said blank having a top edge and a bottom edge joined by side edges;

rolling said blank to form a tubular body with said side edges overlapping each other, wherein said tubular body defines a desired tubular body diameter;

selectively fixing said overlapping side edges relative to each other;

unfixing said overlapping side edges relative to each other;

repositioning said overlapping side edges relative to each other to define a different tubular body diameter; and selectively refixing said overlapping side edges relative to each other.

* * * * *

UNITED STATES PATENT AND TRADEMARK OFFICE

CERTIFICATE OF CORRECTION

PATENT NO. : 6,789,697 B2
DATED : September 14, 2004
INVENTOR(S) : Carl R. Neess It is certified that error appears in the above-identified patent and that said Letters Patent is hereby corrected as shown below:

Column 5,
Line 14, replace the words "inward" with -- inwardly --
Line 44, insert the word -- a -- before the words "bottom edge"

Signed and Sealed this

Twenty-second Day of March, 2005

JON W. DUDAS
*Director of the United States Patent and Trademark Office*